US009224558B2

(12) United States Patent
Gerving et al.

(10) Patent No.: US 9,224,558 B2
(45) Date of Patent: Dec. 29, 2015

(54) POLARITY INDEPENDENT SWITCHING DEVICE FOR CARRYING AND DISCONNECTING DIRECT CURRENT

(71) Applicant: Eaton Electrical IP GmbH & Co. KG, Schoenefeld (DE)

(72) Inventors: Karsten Gerving, Bonn (DE); Volker Lang, Bonn (DE); Johannes Meissner, Bonn (DE); Ralf Thar, St. Augustin (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 10 days.

(21) Appl. No.: 14/105,218

(22) Filed: Dec. 13, 2013

(65) Prior Publication Data

US 2014/0166620 A1 Jun. 19, 2014

(30) Foreign Application Priority Data

Dec. 13, 2012 (DE) ..... 10 2012 112 202

(51) Int. Cl.

| | |
|---|---|
| ***H01H 33/18*** | (2006.01) |
| ***H01H 9/44*** | (2006.01) |
| ***H01H 9/46*** | (2006.01) |
| ***H01H 33/64*** | (2006.01) |
| ***H01H 1/20*** | (2006.01) |
| ***H01H 9/36*** | (2006.01) |
| ***H01H 50/54*** | (2006.01) |

(52) U.S. Cl.

CPC ..... *H01H 33/18* (2013.01); *H01H 9/443* (2013.01); *H01H 9/46* (2013.01); *H01H 33/64* (2013.01); *H01H 1/20* (2013.01); *H01H 9/36* (2013.01); *H01H 50/546* (2013.01)

(58) Field of Classification Search

CPC ..... H01H 9/44; H01H 9/443; H01H 33/021; H01H 33/18; H01H 33/182; H01H 33/187; H01H 33/64; H01H 33/12; H01H 33/20; H01H 33/122; H01H 33/596

USPC ..... 218/22, 31, 37, 68; 200/243; 335/201

See application file for complete search history.

(56) References Cited

U.S. PATENT DOCUMENTS

| | | | | | |
|---|---|---|---|---|---|
| 4,618,753 | A | * | 10/1986 | Heyde et al. | 218/85 |
| 5,004,874 | A | * | 4/1991 | Theisen et al. | 218/151 |
| 5,142,111 | A | * | 8/1992 | Blanchard et al. | 218/22 |
| 5,341,191 | A | * | 8/1994 | Crookston et al. | 335/16 |
| 5,680,084 | A | | 10/1997 | Kishi et al. | |
| 5,818,003 | A | * | 10/1998 | Moldovan et al. | 218/26 |
| 8,368,492 | B1 | * | 2/2013 | Theisen et al. | 335/201 |
| 8,389,886 | B2 | * | 3/2013 | Dahlquist et al. | 218/59 |

* cited by examiner

*Primary Examiner* — Renee Luebke
*Assistant Examiner* — William Bolton
(74) *Attorney, Agent, or Firm* — Leydig, Voit & Mayer, Ltd.

(57) ABSTRACT

A polarity-independent switching device for carrying and disconnecting high DC currents has a gastight, encapsulated, electrically insulating housing which can be filled with an insulating gas, and at least one pair of contacts disposed in the housing and made up of a fixed contact and a mobile contact. The two contacts are in contact with each other in a switched-on state of the switching device and are not in contact in a switch-off state of the switching device. An arc driver arrangement is included which generates a magnetic field at least in the region of the pair of contacts, as well as a first arc routing arrangement with which an arc produced between the contacts is guided in a first current direction to a quenching area arranged at a distance from the contacts.

10 Claims, 5 Drawing Sheets

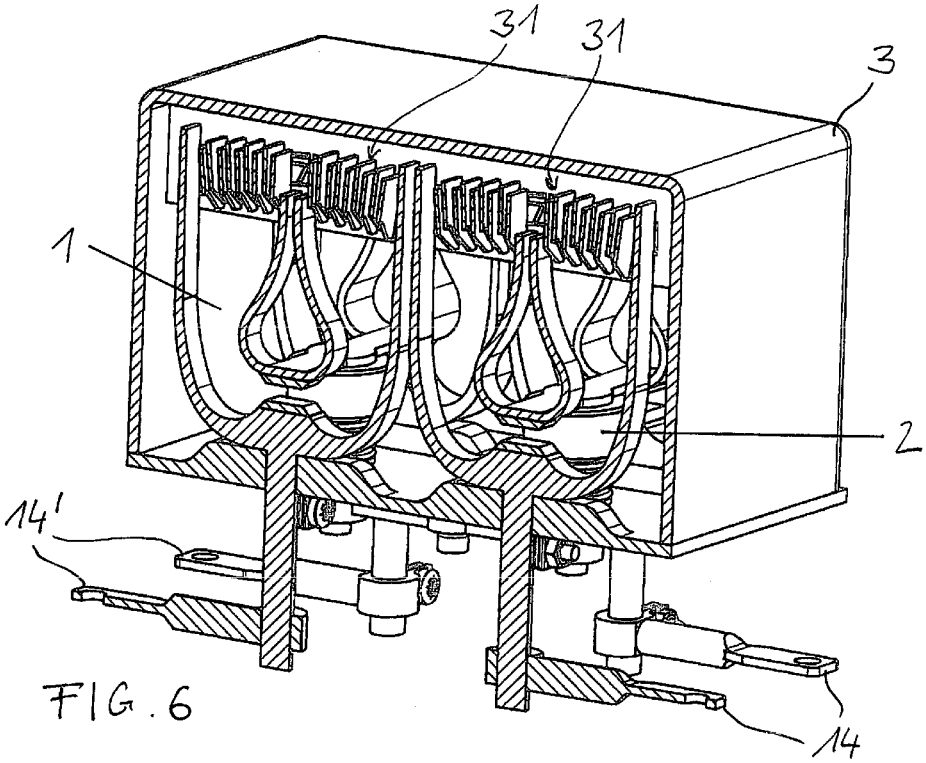
FIG. 6
FIG. 7
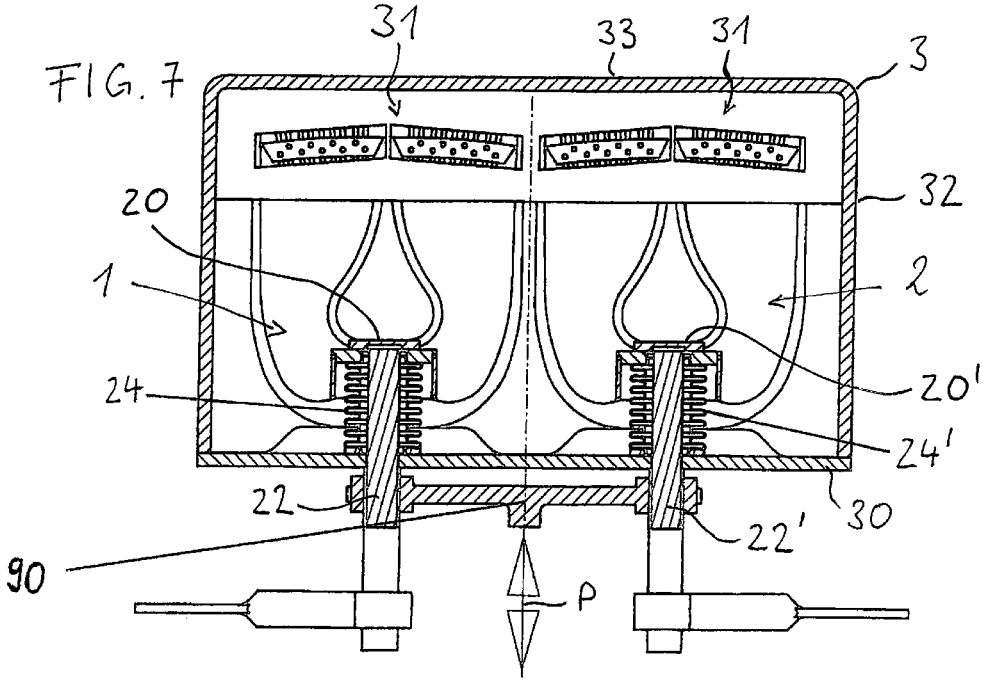

POLARITY INDEPENDENT SWITCHING DEVICE FOR CARRYING AND DISCONNECTING DIRECT CURRENT

CROSS-REFERENCE TO RELATED APPLICATIONS

Priority is claimed to German Patent Application No. 10 2012 112 202.4, filed on Dec. 13, 2012, the entire disclosure of which is incorporated by reference herein.

FIELD

The invention concerns a polarity independent switching device for carrying and disconnecting high direct current. The switching device comprises a gastight encapsulated, electrically insulating housing which can be filled with an insulating gas, at least one pair of contacts disposed in the housing and made up of a fixed contact and a mobile contact, where the two contacts are in contact with each other in the switched-on state of the switching device and are not in contact in the switched-off state of the switching device, further comprising an arc driver arrangement which generates a magnetic field at least in the region of the pair of contacts, as well as a first arc routing arrangement by means of which an arc which is produced between the contacts is guided in a first current direction to a quenching area which is arranged at a distance from the contacts.

BACKGROUND

A switching device of this kind is presented for example in U.S. Pat. No. 5,680,084 A. The housing described in the respective patent is filled with a gas mixture containing hydrogen. There are known other switches in which one or a multitude of pairs of contacts are provided and which are operated in air. When breaking such a switch, a switching arc is produced between the pair of contacts. In alternating current applications, this switching arc produced between the contacts extinguishes at the natural zero passage of the current, producing a permanent interruption of the current flow. Especially in case of higher currents, the switching arc is driven away from the contacts and extended until it extinguishes due to deionization and cooling, this being achieved by a magnetic blowout field, which is generated by an external system of permanent magnets or a self-magnetic field in the switch itself generated by current paths arranged accordingly. There are switches with known quench systems, for example in the form of what are called deionizing chambers, where the switching arc is separated into a multitude of partial arcs and cooled simultaneously by the chamber walls and baffle plates, causing a fast increase of the voltage of the switching arc and therefore the arc is quenched not later than when the driving voltage is reached, thus causing a permanent interruption of the electrical current.

Depending on the energy content of the arc, this process causes a variable level of thermal load on the contact arrangement, together with a certain burn-off of the contact material. Thermal load is also generated to the switching chamber walls and the arc chutes, resulting in a limitation of the electrical useful life of the switching device. The switching device is exposed to high load during the switching process especially in case of higher arc-power, more especially in case of reduced or missing mobility of the arc, causing a similarly high burn-off of contacts and material changes of the switching chamber walls due to localized high thermal load.

A high thermal load of the switching chambers is generated especially in case of high direct currents, which contrary to similar alternating currents, have no sinusoidal current curve with a natural zero passage of the current, and therefore when disconnecting the contacts, they generate a constant high-power arc. To ensure a maximum possible useful life of a switching device for direct current applications, it is therefore indispensable to minimize the burning time of the switching arc through fast cooling and deionization of the switching path. In this process the burning voltage is increased rapidly, which causes the extinguishing of the arc when the driving voltage is reached.

In case of known arrangements for extinguishing direct currents, where the switching arcs are driven by magnetic blowout fields into what are called deionizing chambers and quenched in these chambers, especially energy-rich arcs can often re-ignite. In this case in a section of the switching path, where the arc no longer has any direct effect, and thus the electrical conductivity is significantly reduced in this area due to the deionization of the surrounding air, the respective section is re-ignited again by the arc, together with a sudden drop of the arc voltage. Repeated re-ignitions can significantly extend the total burning time of the switching arc, which in turn causes an increased thermal load to the switching device. Switching processes with frequent re-ignitions cause therefore a reduction of the useful life of the switching device.

A very efficient extinguishing of the arc is achieved when instead of normal air as the switching environment, hydrogen or a gas mixture containing hydrogen is used in a hermetically sealed housing of the switch. It is known that due to the significantly higher particle velocity of hydrogen molecules as compared to air molecules, hydrogen molecules produce a very efficient cooling and deionization of the switching path. As a result, in case of switching in a hydrogen atmosphere, the arc voltage of a freely burning arc is several times higher than the voltage achievable in air with the same switching arrangement. In practice, this means that by specifically extending the switching arc by a magnetic blowout field, a higher arc voltage can be generated as compared to the voltage reached by separating the arc into a multitude of partial arcs through a classical arrangement using baffle plates.

Encapsulated switching devices filled with hydrogen are found in several products today in the form of compact relays for currents up to several hundred amperes. These products are designed especially as having a very compact arrangement to carry the currents of this magnitude continuously and switch these currents typically several thousand times. With these compact switching chambers, however, the number of switching operations achievable is limited in case of high switching power due to the gradually decreasing insulating strength.

SUMMARY

In an embodiment, the present invention provides a switching device suitable for direct current operation, the device including: a gas-tight, encapsulated, electrically insulating housing configured to be filled with an insulating gas. A pair of contacts is disposed in the housing, the contacts including a fixed contact and a mobile contact, the pair of contacts being in contact with each other in a switched-on state of the switching device, and the pair of contacts being not in contact in a switched off-state of the switching device. An arc driver arrangement is included configured to produce a magnetic field at least in the region of the contact pair. A first arc routing arrangement is included with which an arc, produced between the contacts, is guidable in a first current direction to a quenching area of the housing, the quenching area being arranged at a distance from the pair of contacts. A second arc routing arrangement is provided such that an arc produced between the contacts is routed in the first current direction opposite to a second current direction in the direction of the quenching area. The fixed contact is connected to a housing bottom. The housing bottom is arranged opposite to the quenching area. The bridge contact piece includes an actuator, the actuator being driven through the housing bottom through a flexible gas seal.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 6 is a perspective view of a further embodiment of the switching device according to the invention;

FIG. 7 is a cross-sectional view of the switching device according to FIG. 6 in a lateral view.

DETAILED DESCRIPTION

Figure 1:
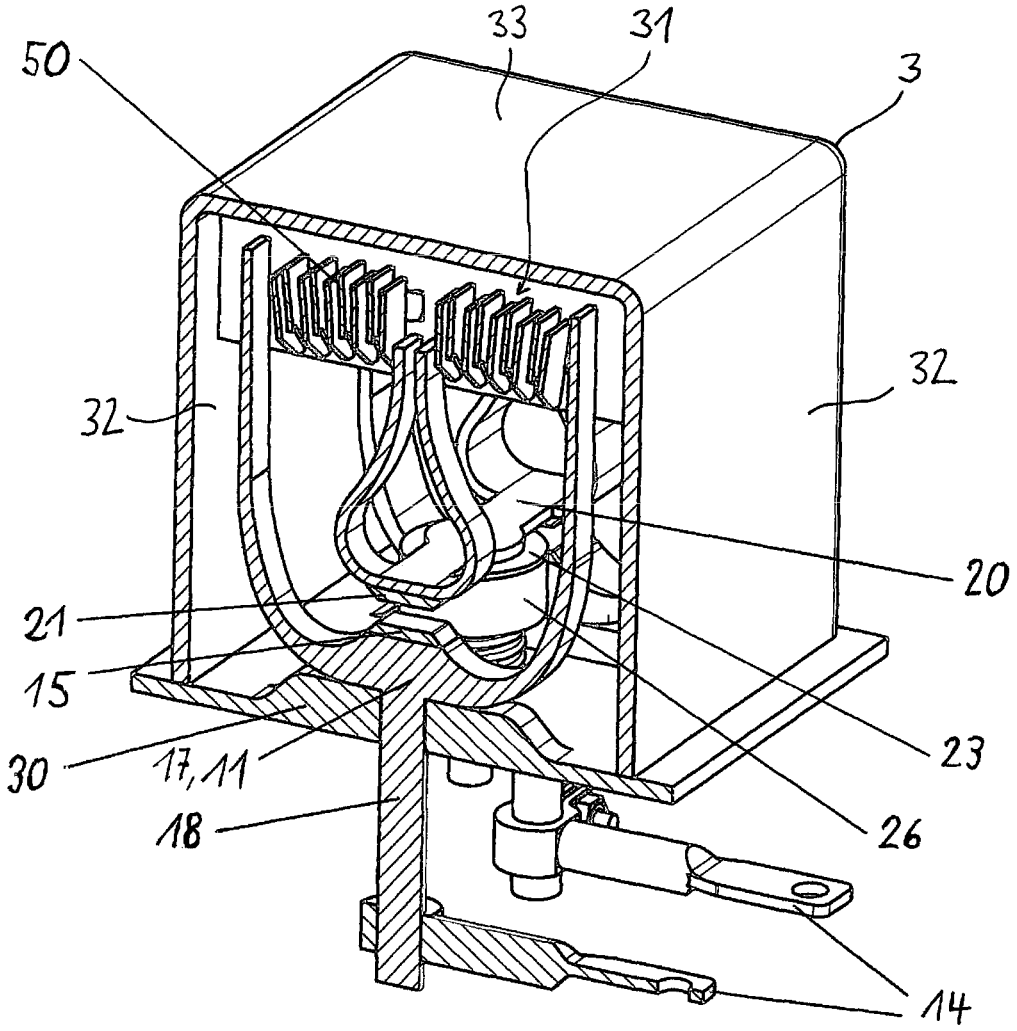
FIG. 1 is a perspective cross-sectional view of the switching device according to a first embodiment of the invention.

The switching device for direct current operation according to the invention comprises a gastight encapsulated, electrically insulated housing which can be filled with an insulating gas. The housing accommodates at least one pair of contacts made up of a fixed contact and a mobile contact, where the two contacts are in contact with each other in the switched-on state of the switching device and are not in contact in the switched-off state of the switching device. Preferably two such pairs of contacts are provided for each pole to implement a double interruption.

Such a switch is preferably for high direct current operation, with a similarly compact arrangement and polarity independent high electrical switching capacity at high switching frequency and high total number of switching operations.

An arc driver arrangement generates a magnetic field at least in the area of the pair of contacts or pairs of contacts, especially a homogenous magnetic field essentially, which is also designated as a blowout field and is suitable for driving one or a multitude of arcs. A first arc routing arrangement is provided to drive an arc produced between the contacts and having a first direction of current in the direction of a quenching area of the housing located at a distance from the contacts. The quenching area refers initially to an area within the housing, which is located sufficiently far from the contacts to avoid damage caused to the contacts by the effect of the arcs. Appropriate additional measures which are described as preferred embodiments can be provided in the quenching area to extinguish the arc.

According to the invention, a second arc routing arrangement is provided in such a manner that an arc produced between the contacts and having a second direction of current opposite to the first direction of current is also driven in the direction of the quenching area.

It is advantageous in this case that both arc routing arrangements are designed such that the arc is driven in the same direction independent of its direction of current, without requiring special insulating separating walls for this purpose. Independent of its polarity, the arc can therefore be driven advantageously quickly into an area of the housing located far from the contacts with the result that the contacts are exposed to lower thermal load. As every arc is driven in the same direction independent of the polarity, a correspondingly compact housing can be used with preferably advantageously reduced space requirements. A permanent magnetic field is preferably generated by permanent magnets, to provide a magnetic field simply and not depending on the current.

The first arc routing arrangement is designed in such a manner that an arc having a first direction of current is deflected in a first direction of rotation and driven in the direction of the quenching area. The second arc routing arrangement is designed in such a manner that an arc having a second direction of current is deflected in a direction of rotation opposite to the first direction of rotation and driven in the direction of the quenching area. This means that the arc is deflected and driven in the direction of the quenching area independent of the direction of current of the arc. In this design, the distances of travel of the arc to reach the quenching area are preferably the same, to ensure identical switching characteristics of the switching device in both directions of current.

It is provided that the fixed contact or fixed contacts is/are connected to the housing bottom. In this manner an especially robust switch is preferably obtained, this only being achieved due to the fact that the arcs can be driven irrespective of polarity such that they are diverted from the housing bottom holding the fixed contacts. Therefore the housing bottom is preferably arranged approximately opposite to the quenching area, or rather the quenching area stretches adjacently to the wall of the housing located opposite to the housing bottom. This relates to a basically rectangular housing, it is transferable though to any other form of housing accordingly. Furthermore, the electrodes leading to the contacts are preferably installed through the housing bottom.

Moreover, it is provided that a contact piece is driven through the housing bottom through a flexible gas seal, wherein the mobile contact is fixed to the contact piece and can be moved from the outside of the housing. Preferably the contact piece is implemented as a bridge contact piece holding two mobile contacts. In case of a double interruption switching device, there are two mobile contacts arranged on the bridge contact piece, wherein the bridge contact piece comprises an actuator which goes through the housing bottom through a flexible gas seal.

In a multi-pole switching device, it is provided that two bridge contact pieces each comprise an actuator which can be moved through the housing bottom through a flexible gas seal, wherein a rigid connection axis between the actuators is provided outside the housing for the purpose of synchronization. In a multi-pole switching device, it can alternatively be provided that two bridge contact pieces are connected by a nonconductive bridge piece and are comprise a common actuator which can be moved through the housing bottom through a flexible gas seal.

For protection from the effect of the arc, it is preferably provided that the part of the flexible gas seal facing the bridge contact piece is preferably surrounded by a protective shield. The flexible gas seal is most preferably designed as a bellows structure, especially made of stainless steel.

According to a further preferred embodiment, it is provided that the first arc routing arrangement comprises of a first section for deflecting the arc by approximately 90° and a second section for driving the arc essentially in a straight line. In the above presented embodiment of the switching device, with the fixed contacts arranged on the housing bottom, the arcs generated between the fixed and the mobile contacts are first directed approximately in a normal direction to the housing bottom. The arc can be rotated through a curved first section of the arc routing arrangement, said first section being located in a plane that is arranged at a right angle to the housing bottom, so that the magnetic field lines of the blowout field are also perpendicular to the field. After rotating by approximately 90°, the arcs run approximately in parallel with the housing bottom so that, from here, the arcs can be moved forward in this second section in a straight line. In this manner, the entire arc or both base points of the arc, respectively, reach the quenching area essentially at the same time.

Preferably each arc is extended along the arc routing arrangement by extending the distance between the base points. Especially the second section of the first arc routing arrangement is arranged in such a manner that the arc is extended in the direction of the quenching area, wherein the alignment of the arc is maintained parallel to the housing bottom.

For this purpose, it is preferably provided that the first arc routing arrangement comprises an external guide plate and an internal guide plate, wherein the external guide plate stretches from the fixed contact and the internal guide plate stretches from the mobile contact. In the second section, the external guide plate preferably runs essentially in parallel with the side walls of the housing. In the second section, the internal guide plate most preferably runs in such a manner that the distance to the external guide plate increases in the direction of the quenching area. Furthermore, the second arc routing arrangement is preferably designed as a mirror image of the first arc driver arrangement.

According to a further preferred embodiment, it is provided that the external guide plates of the first and second arc routing arrangements make up a U-shape together with the contact support, wherein the contact support makes up the base of the U-shape and wherein the fixed contact is arranged in the area of the base with respect to the U-shape.

Therein, the base of the U-shape has a thickening especially in the direction of the interior region of the U-shape, wherein the fixed contact is arranged on this thickened part.

According to a further preferred embodiment, it is provided that the internal guide plates of the first and second arc routing arrangements make up a joint structure in the shape of the contour of an onion.

Furthermore, it is preferably provided that there is a stepless transition from the respective contact to the guide plate. For this purpose the border areas of the contacts especially have a bevel. This allows a quick and harmonic transition of the arc base points from the contact surfaces to the guide rails, wherein this advantageously minimizes any material burn-off caused by the arcs.

According to a further preferred embodiment, it is provided that 5 each arc routing arrangement is fitted with a quenching device comprising a multitude of electrically insulating quenching plates arranged in parallel to each other in the area of the quenching area. The quenching devices are preferably formed in such a manner that the arc is extended in a meander shape. For this purpose, it is preferably provided that the quenching plates project from an inlet side of the quenching devices in a varying manner. Additionally or alternatively, it is preferably provided that the quenching plates are alternately shorter and longer. In addition, it is preferably provided that the quenching plates each have a notch at the inlet side of the quenching devices, said notch having an asymmetrical shape and/or being arranged off-center. This especially results in the fact that the notches of all quenching plates make up a groove of an irregular course.

According to a further preferred embodiment, it is provided that the insulating gas is made up of hydrogen or a gas mixture containing hydrogen.

Figure 2:
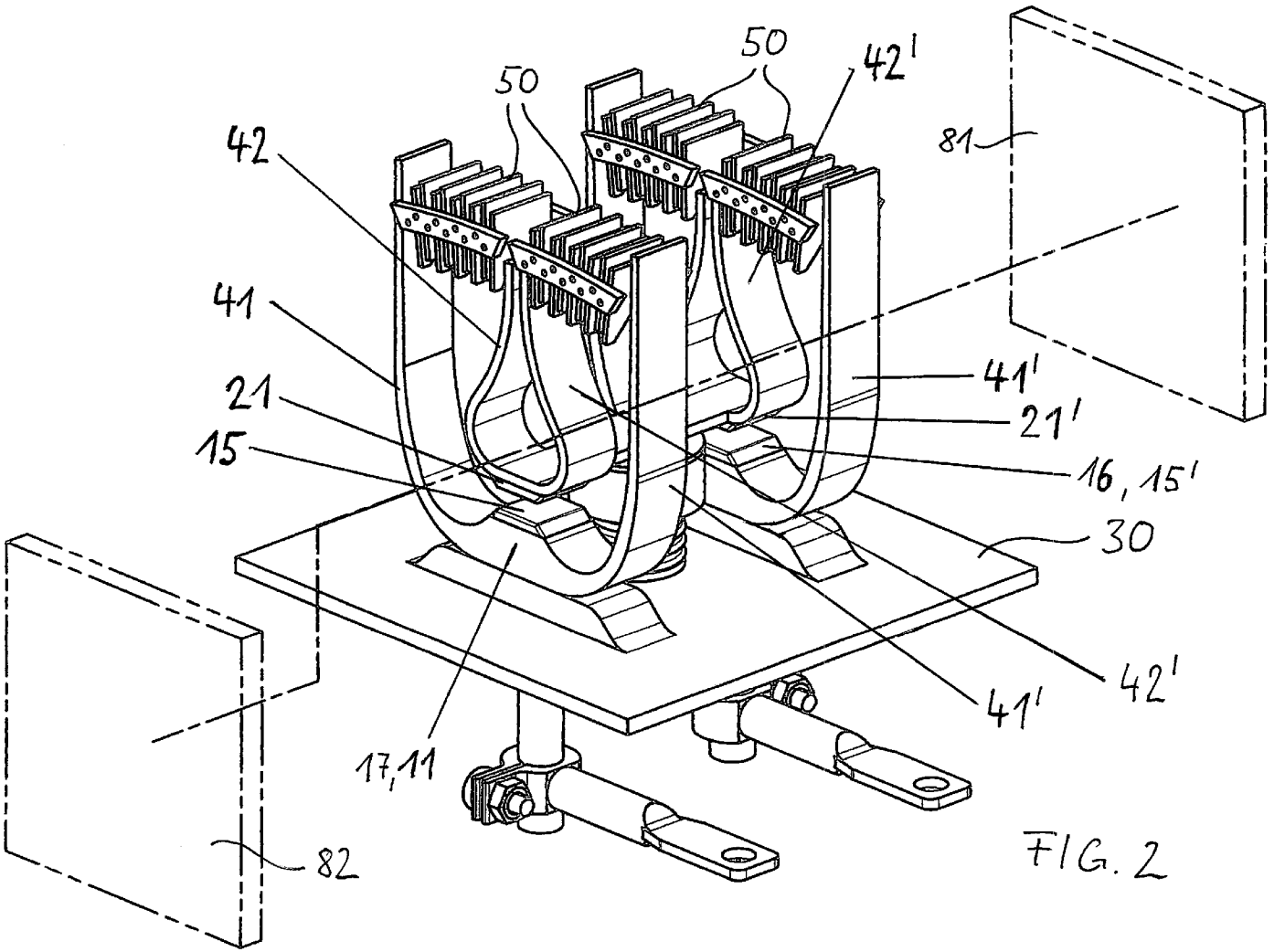
FIG. 2 is a perspective view of the switch arrangement of the switching device according to FIG. 1, without a housing.
Figure 3:
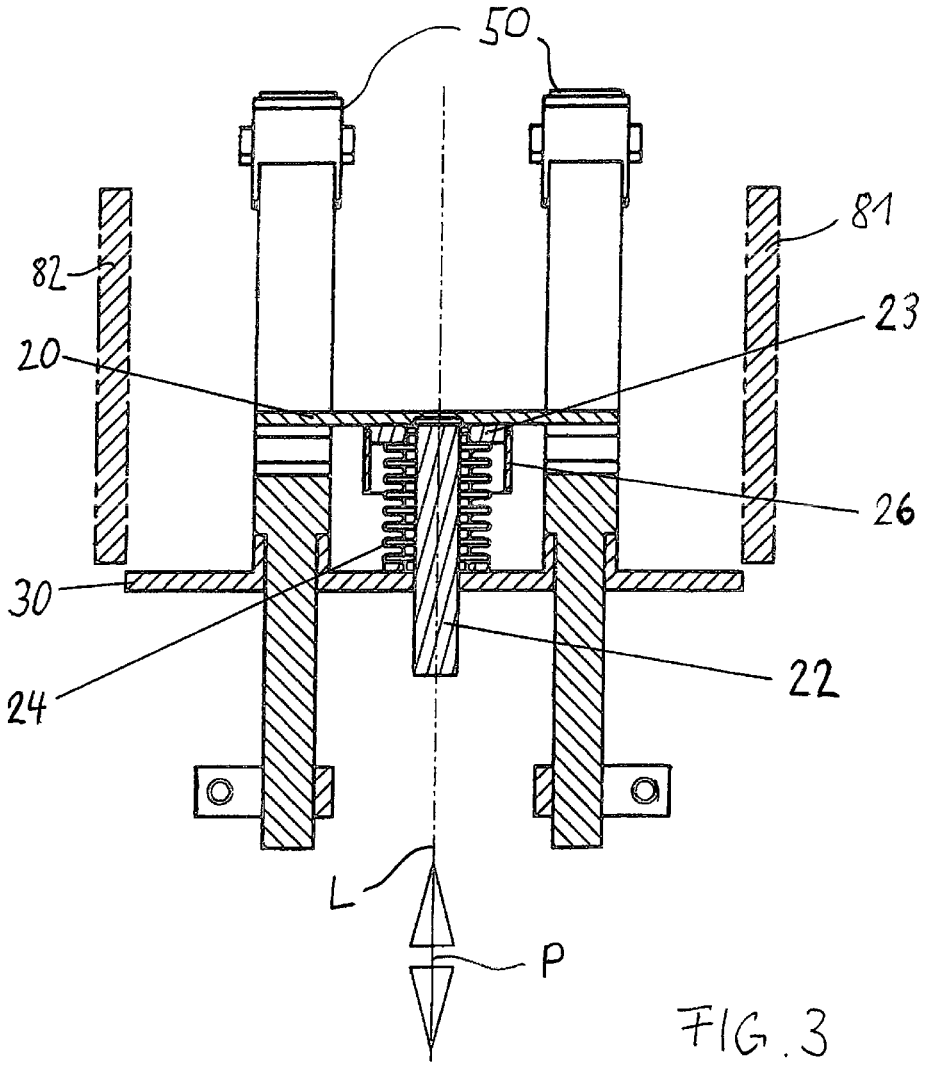
FIG. 3 is a lateral view of the switch arrangement according to FIG. 2 in a longitudinal section.

FIGS. 1 to 3 show the switching device according to the invention in its various representations, where FIG. 2 and FIG. 3 do not show a housing 3 of the switching device for the sake of clarity. FIGS. 1 to 3 are presented jointly below. The switching device for direct current operation according to the invention comprises a gastight encapsulated, electrically insulating housing 3 which can be filled with an insulating gas. The housing 3 accommodates at least one pair of contacts 15, 21 made up of a fixed contact 15 and a mobile contact 21, where the two contacts 15, 21 are in contact with each other in the switched-on state of the switching device and are not in contact in the switched-off state of the switching device. Preferably, two such pairs of contacts 15, 21, 15', 21' are provided for each pole 14 to implement a double interruption. An arc driver arrangement 81, 82 generates a magnetic field at least in the area of the pair of contacts 15, 21 or pairs of contacts 15, 21, 15', 21', especially a homogenous magnetic field essentially, which is also designated as a blowout field and is suitable for driving one or a multitude of arcs. A first arc routing arrangement 41, 42 is provided to drive an arc produced between the contacts 15, 21 and having a first direction of current in the direction of a quenching area 31 of the housing 3 located at a distance from the contacts. The quenching area 31 refers to an area within the housing 3, which is located sufficiently far from the contacts 15, 21 to avoid damage caused to the contacts by the effect of the arcs. In case of the embodiment shown, further measures which will still be described in more detail are provided in the quenching areas to extinguish the arc.

According to the invention, a second arc routing arrangement 41', 42' is provided in such a manner that an arc produced between the contacts 15, 21 and having a second direction of current opposite to the first direction of current is also driven in the direction of the quenching area 31. The fixed contact 15 is connected to the housing bottom 30 which is arranged approximately opposite to the quenching area 31. Preferably the quenching area 31 is located adjacent to a housing wall 33 which is located opposite to the housing bottom 30. Side walls 32 can be formed integrally with the housing wall 33.

In the embodiment shown here, the contact system comprises a double circuit breaker arrangement with two identical contacts 15, 15', and a mobile contact piece 20 with two mobile contacts 21, 21'. The fixed contacts 15, 15' are designed in such a manner that they consist of a contact support 11 and a contact plate which are preferably connected by a flat solder joint. From the contact support 11 two metal 5 strips extend as outer arc deflectors 41 made of copper or a burn-off resistant metal in opposite directions, in such a manner that they run outwards from the contact support 11, initially ramped in direction of the base plate 30, and then gradually run parallel in direction of the longitudinal axis L shown in FIG. 3. This arrangement, which thereby forms a centrally inward dented "U", on the base 17 of which the fixed contact 15 is located, functions as an arc guide rail 41 for the base points of the arc that are produced on the fixed contacts when the contact bridge 20 is opened under electrical load.

The contact supports 11 each end in the electrodes 18, preferably in the form of cylindrical connecting ports 18, wherein the connecting ports 18 are permanently connected to the base plate 30 of the hermetically sealed switching chamber 3, preferably by a solder joint, in such a manner that they are electrically insulated. Electrical insulation is achieved in that the base plate 30 is made of insulation material, preferably ceramic. The cylindrical connection ports 18 serve as connector to the two power supply lines 14.

In order to achieve as rapid a migration of the switch arc from the contact pairs 15, 21, 15', 21' as possible under the influence of a magnetic blowout field, which is described in detail below, the lateral surfaces 16 of the contacts 15 in the direction of the arc guide rails 41, 41' are preferably bevelled or chamfered in such a manner that a stepless transition is possible from contact 15, 21, 15', 21' to guide rails 41, 42, 41', 42' which favors a rapid burn-off-free migration of the switching arcs of the contacts 15, 21, 15', 21'. The U-shaped arc guide rail arrangements 41, 41' of the two fixed contacts 15, 15' are parallel to each other. Electrical connection of the two fixed contacts 15, 15' is achieved through the bridge contact piece 20, consisting of a carrier part each with a mobile contact 21, 21' on both ends, which are preferably connected to the carrier part by flat solder joints. In order to actuate the bridge contact piece 20, it is permanently connected in its center to a cylindrical switching axis as actuator 22, which consists, at least partially, of insulating material and is movable in the direction of the double arrow P along the axis L. The movability of the bridge contact piece 20 in the interior region of the gastight switching chamber 3 is ensured through bellows 24, preferably made of stainless steel, which is preferably located in the interior region of the switching chamber 3 wherein its one narrow side is connected to the base plate 30 and its other narrow side is connected to a connecting plate 23 which is permanently connected to the bridge contact piece 20 in a gastight manner via a circumferential solder joint. In order to protect the thin-walled bellows 24 against the effects of individual stray arcs, that part of the bellows 24 which faces the bridge contact piece 20 is concentrically covered by a protective shield 26 preferably made of metallic material. The protective shield 26 is preferably connected to the connecting plate 23 of the bridge contact piece 20 through a solder joint. In order to shunt and conduct the bridge-side base points which are under the load of the two developing partial arcs when the switching contacts 15, 21 are opened, two arc deflectors 42, 42' having the form of metal strips made of copper or burn-off resistant metal start from each bridge contact 21, 21' and extend in opposite directions (in analogy to the fixed contacts 15, 15'), this being done in such a manner that they initially extend at a slanted angle towards the contact backside and outwards, then at a slanted angle back inwards, until both ends finally end in a parallel direction to each other. The form of the arc guide rails 42, 42' on the jumper side described above has more or less the profile of an onion. Herein, the bridge-side guide rails 42, 42' are positioned in one plane with the fixed contact-side guide rails 41, 41' in such a manner that the rails 41, 42 which are each associated with a the contact pair 15, 21 extend in one plane, wherein both planes of the contact pairs are parallel to each other on their part. This results in a continuously diverging guide rail arrangement, with the help of which an arc moving away from a contact pair 15, 21 under the influence of a magnetic blowout field is expanding wherein the arc voltage increases continuously. In an atmosphere of hydrogen or a gas mixture containing hydrogen, the expansion of the arc results in an arc voltage that is several times higher so that enables a very efficient quenching of the arc. In the same manner as in the fixed contact arrangement 15, 15', a stepless transition can also be achieved in the mobile contacts 21, 21' by means of a chamfer of the lateral surfaces 16 of the contacts 21, 21' in the direction of the arc guide rails 42, 42', which favors a rapid low-burn-off migration of the arc from the contacts 21, 21'.

The switching chamber described in FIGS. 1 to 3 has a mirror symmetrical structure in such a manner that, due to the effect of the homogeneous magnetic field acting there, the two partial arcs which are produced when the two contact pairs 15, 21, 15', 21' are opened are always moved away homogeneous from the contact independent of the 35 current flow direction, each along one of the two diametrically opposite guide rail arrangements 41, 42, 41', 42' under continuous expansion, until the arcs meet the meander chamber 50 disposed at the end of the diverging guide rail pair, where they are further elongated due to their geometry and are extinguished there at the latest, which will be discussed in depth later. For rapid forward movement and for extinguishing the switching arcs produced due to opening of the contacts 15, 21, 15', 521', the switching chamber—or at least the part directly affected by the arc—is located in a largely homogeneous magnetic field. Most conveniently used for this purpose, as shown in FIGS. 2 and 3, is a plate-shaped pair of permanent magnets 81, 82, which are arranged in the correct magnetic polarity parallel to each other in such a manner that the field lines run largely perpendicular to the planes spread by the arc guide rails 41, 42, 41', 42'. Alternatively, to generate a homogeneous permanent magnetic field, a ferromagnetic arrangement of parallel pole plates can be used, which are connected to one or more permanent magnets of sufficient field strength in an appropriate manner. In principle, a permanent magnet arrangement can be found both inside and outside the encapsulated switching chamber 3. In order to implement as compact and cost-effective a switching chamber as possible, it is appropriate to dispose the permanent magnet arrangement outside the switching chamber.

Figure 4:
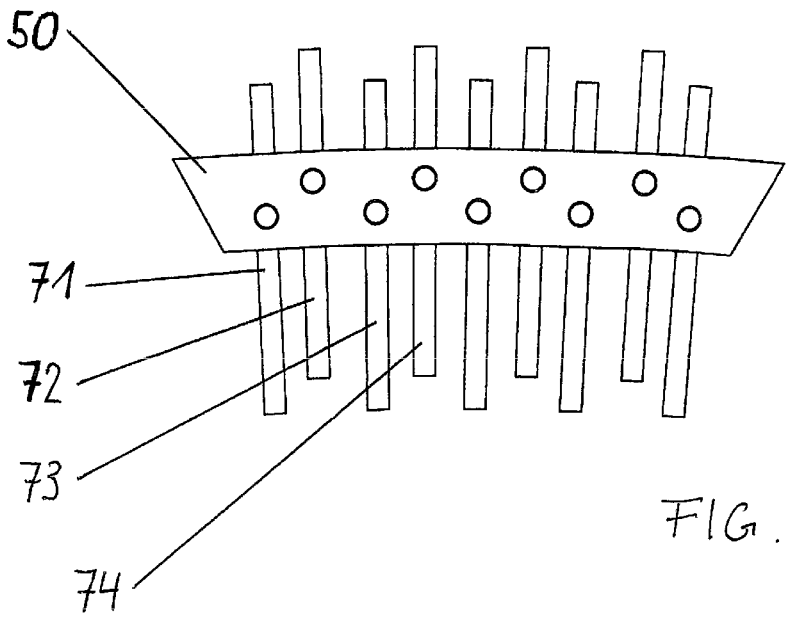
FIG. 4 is a lateral view of a quenching device of the switching device according to FIG. 1.
Figure 5:
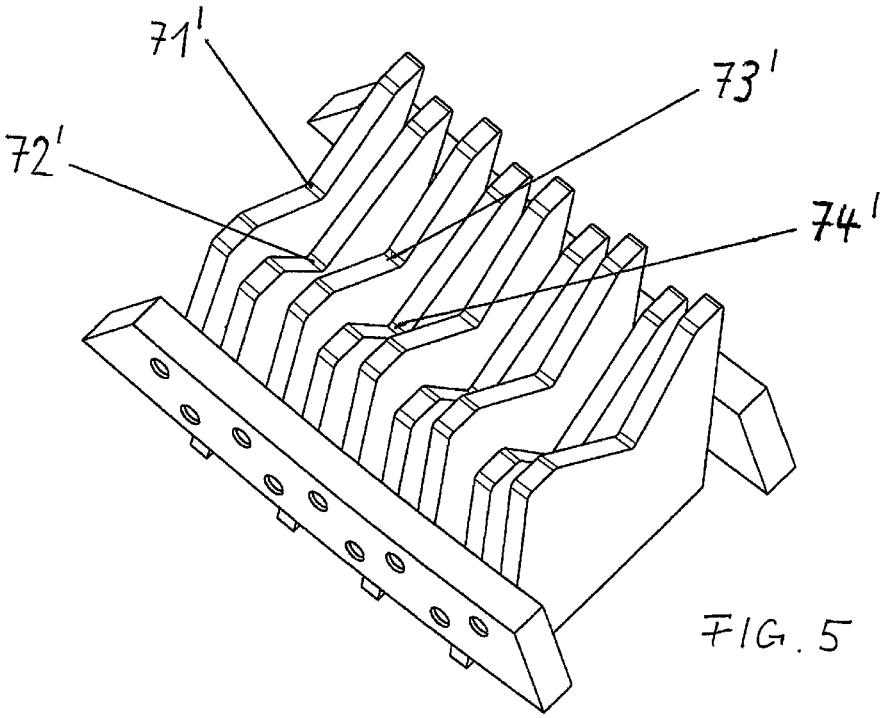
FIG. 5 is a perspective view of the quenching device of the switching device according to FIG. 4.

In order to further elongate the arc, the latter is driven into what is called a meander chamber under the influence of a permanent magnetic blowout field, said meander chamber constituting a quenching device 50 which is described below with respect to FIGS. 4 and 5. The meander chamber 50 consists of a stacked arrangement of plates 71, 72, 73, 74 made of a burn-off-resistant insulation material, preferably ceramic, said plates being spaced apart from each other by a defined distance and fixed in position in a frame that is also made of insulation material, in analogy with the deionising chambers frequently used when switching in air is required. In an advantageous embodiment of the meander chamber 50 and as shown in FIG. 4, the leading edges of this stack arrangement facing the switching arc are not arranged along a straight line, but the end faces of the respectively adjacent plates 71, 72, 73, 74 are arranged such that they are offset to each other in the direction of travel of the arc front. Alternatively, the stack arrangement can be made up of plates of different lengths, in such a manner that, here as well, a shorter plate is followed by a longer plate and vice versa, so that the end faces of respectively adjacent plates are arranged offset to each other in the direction of travel of the arc front. Unlike a deionization chamber in which the switching arc is divided into a multitude of individual partial arcs whose arc length in each case corresponds to the clear distance between adjacent quenching plates, wherein the total arc voltage generated in the deionizing chamber is the sum of the voltages of all partial arcs, the arc is not divided when it enters the meander chamber but is specifically extended by clinging to the individual chamber plates 71, 72, 73, 74 as well as by the bulge into the space between the plates caused by the blowout fields. Plate arrangement in the direction of travel of the arc front in the form just explained therefore results in an additional elongation of the arc. Additional amplification of the arc bulge is possible, as shown in FIG. 5, through an asymmetric indent of the meander-plates 71, 72, 73, 74 on the narrow side facing the arc front, wherein the indents 71', 72', 73', 74' of the respectively adjacent plates 71, 72, 73, 74 are always offset to each other. As a result, such a meander chamber 50 design, with the diverging arc guide rail arrangement 41, 42 as well as the plates 71, 72, 73, 74 which are offset to each other in the travel direction of the arc, causes an even increased bulge of the switching arc, which represents an efficient method for increasing the arc voltage and therefore as quickly an extinguishing of the switching arc as possible in a switching chamber area with hydrogen or a hydrogen-containing gas mixture.

The embodiments of a gas-encapsulated switching device described so far were related to polarity-independent, single-pole configurations. With the same basic structure, two or multi-pole switching devices can also be implemented, which will be explained in more detail with reference to FIGS. 6 and 7. This can be done in such a manner that the switching arrangements 1, 2 of the individual poles 14, 14' are housed in the same gas-encapsulated switching chamber 3, wherein the switching arrangements 1, 2 of the individual poles are protected against any arc influence of the neighboring poles either via suitably arranged partition panels or by distances which are sufficient in size. Herein, the movement of the individual bridge contact pieces 20, 20' can be synchronized in two ways: either the bridge contact pieces 20, 20' are disposed in a common jumper of insulating material (not shown) which can be moved via a common bellows that is mounted in a gastight manner outside the switching chamber in the same manner as in case of the single-pole embodiment already described. In the second variation, as shown in FIGS. 6 and 7, each pole has its own mobile switching axis 22, 22', each provided with a bellows 24, 24' which is sealed against the control chamber 3 in a gastight manner. Herein, the synchronization of the two switching axes 22, 22' takes place from the outside of the switching chamber 3 by a rigid connection axis 90 between the switching axes that can be moved in the direction of the double arrow P. A multi-pole embodiment can also be achieved in such a manner that the switching arrangements are for each pole accommodated in separate chambers each of which is hermetically sealed (not shown), wherein there is a separate linear feedthrough for the jumpers of each pole, said linear feedthrough being sealed against the bellow and being synchronized via a rigid connection axis as has just been described above.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SYMBOLS

1, 2 Switching apparatus
3 Housing
11 Switching unit
14, 14' Poles, connections
15, 15' Fixed contacts
16 Lateral surfaces, chamfer
17 Base
18 Electrodes
20, 20' Contact pieces, bridge contact pieces, jumpers
21, 21' Mobile contacts
22, 22' Actuator
23 Connecting plate
24, 24' Flexible gas seals, bellows
26 Shield
30 Base plate
31 Quenching area
30 Side wall
33 Housing wall
41 Outer baffle plate of the first arc routing arrangement
41' Outer baffle plate of the second arc routing arrangement
42 Inner baffle plate of the first arc routing arrangement
42' Inner baffle plate of the second arc routing arrangement
50 Quenching device
71, 72, 73, 74 Quenching plates
81, 82 Permanent magnets
90 Connection
P, L Double arrow, longitudinal direction

The invention claimed is:

1. A switching device suitable for direct current operation, the device comprising:

a gas-tight encapsulated, electrically insulating housing configured to be filled with an insulating gas;

a pair of contacts disposed in the housing, the contacts including a fixed contact and a mobile contact, the pair of contacts being in contact with each other in a switched-on state of the switching device, and the pair of contacts being not in contact in a switched off state of the switching device;

an arc driver arrangement configured to produce a magnetic field at least in the region of the contact pair;

a first arc routing arrangement with which an arc, produced between the contacts, is guidable in a first current direction to a quenching area of the housing, the quenching area being arranged at a distance from the pair of contacts; and a second arc routing arrangement, provided such that an arc produced between the contacts is routed in a second current direction opposite to the first current direction in the direction of the quenching area, wherein each arc routing arrangement comprises an external guide plate that stretches from the fixed contact and an internal guide plate that stretches from the mobile contact, and the distance between the external guide plate and the internal guide plate increases in the direction of the quenching area, wherein the fixed contact is connected to a housing bottom, wherein the housing bottom is arranged opposite to the quenching area, and wherein a bridge contact piece, on which the mobile contact is disposed, includes an actuator, the actuator being driven through the housing bottom through a flexible gas seal.

2. The device of claim 1, wherein the device is a multi-pole switching device, comprising:

two bridge contact pieces each including an actuator configured to be moved, via a flexible gas seal, through the housing bottom; and a rigid connecting axis, provided between the actuators outside the housing for synchronization.

3. The device of claim 1, wherein the first arc routing arrangement includes a first section configured to deflect the arc by about 90° and a second section configured to route the arc in an essentially straight path.

4. The device of claim 1, comprising a stepless transition from each contact to its respective arc routing arrangements.

5. The device of claim 1, comprising, for each arc routing arrangement, a quenching device including a multitude of electrically insulating-quenching plates that are arranged parallel to each other, provided in the region of the quenching area.

6. The device of claim 5, wherein the quenching devices are shaped in such a manner that the arc expands in a meandering form.

7. The device of claim 1, wherein the switching device is a double interruption switching device, comprising two mobile contacts arranged on the bridge contact piece.

8. The device of claim 1, wherein the first arc routing arrangement includes a first section configured to deflect the arc by 90° and a second section configured to route the are in a straight path.

9. A switching device suitable for direct current operation, the device comprising:

a gas-tight encapsulated, electrically insulating housing configured to be filled with an insulating gas;

a pair of contacts disposed in the housing, the contacts including a fixed contact and a mobile contact, the pair of contacts being in contact with each other in a switched-on state of the switching device, and the pair of contacts being not in contact in a switched off-state of the switching device;

an arc driver arrangement configured to produce a magnetic field at least in the region of the contact pair;

a first arc routing arrangement with which an arc, produced between the contacts, is guidable in a first current direction to a quenching area of the housing, the quenching area being arranged at a distance from the pair of contacts; and a second arc routing arrangement, provided such that an arc produced between the contacts is routed in the first current direction opposite to a second current direction in the direction of the quenching area, wherein the fixed contact is connected to a housing bottom, wherein the housing bottom is arranged opposite to the quenching area, wherein the bridge contact piece includes an actuator, the actuator being driven through the housing bottom through a flexible gas seal, wherein external guide plates of the first and second arc routing arrangements form a U-shape together with a contact support, wherein the contact support forms a U-shaped base, and wherein the fixed contact is arranged in the interior region of the area of the base.

10. A switching device suitable for direct current operation, the device comprising:

a gas-tight encapsulated, electrically insulating housing configured to be filled with an insulating gas;

a pair of contacts disposed in the housing, the contacts including a fixed contact and a mobile contact, the pair of contacts being in contact with each other in a switched-on state of the switching device, and the pair of contacts being not in contact in a switched off-state of the switching device;

an arc driver arrangement configured to produce a magnetic field at least in the region of the contact pair;

a first arc routing arrangement with which an arc, produced between the contacts, is guidable in a first current direction to a quenching area of the housing, the quenching area being arranged at a distance from the pair of contacts; and a second arc routing arrangement, provided such that an arc produced between the contacts is routed in the first current direction opposite to a second current direction in the direction of the quenching area, wherein the fixed contact is connected to a housing bottom, wherein the housing bottom is arranged opposite to the quenching area, wherein the bridge contact piece includes an actuator, the actuator being driven through the housing bottom through a flexible gas seal, and wherein internal guide plates of the first and second arc routing arrangements together form an onion contour shape.

* * * * *